United States Patent [19]

Sutherland

[11] Patent Number: 4,920,957

[45] Date of Patent: May 1, 1990

[54] SCALP KNEADER

[76] Inventor: W. Don Sutherland, R.R. #2 Glenbow Rd., Cochrane, Alberta, Canada, T0L 0W0

[21] Appl. No.: 208,944

[22] Filed: Jun. 20, 1988

[51] Int. Cl.[5] ..... A61H 7/00

[52] U.S. Cl. ..... 128/52; 128/59

[58] Field of Search ..... 128/51, 52, 56, 57, 128/59, 60, 25 B, 33, 55, 46, 49, 44

[56] References Cited

U.S. PATENT DOCUMENTS

| | | | |
|---|---|---|---|
| 1,391,919 | 9/1921 | Thompson | 128/59 |
| 1,577,751 | 3/1926 | Paschall | 128/51 |
| 1,612,899 | 1/1927 | Ahlgren | 128/59 |
| 1,709,170 | 4/1929 | Hassler | 128/52 |
| 1,931,849 | 10/1933 | Matson | 128/56 |
| 2,038,846 | 4/1936 | Matson | 128/46 |
| 2,232,493 | 2/1941 | Stuckey et al. | 128/61 |
| 2,706,980 | 4/1955 | Kahn | 128/59 |
| 3,499,439 | 3/1970 | Boller | 128/49 |
| 3,517,235 | 6/1970 | Flowers et al. | 15/22 R |
| 3,845,758 | 11/1974 | Anderson | 128/49 |
| 3,993,052 | 11/1976 | Miyahara | 128/46 |
| 4,777,940 | 10/1988 | Yamasaki | 128/59 |

FOREIGN PATENT DOCUMENTS

| | | | |
|---|---|---|---|
| 385711 | 1/1933 | United Kingdom | 128/60 |

*Primary Examiner*—Edgar S. Burr
*Assistant Examiner*—Huong Q. Pham
*Attorney, Agent, or Firm*—George Dunsmuir

[57] ABSTRACT

Conventional massage devices rely on rotary motion for massaging the skin or tissue of the user. A massage device for effecting a gentle kneading of the scalp includes a casing with an open bottom end, a pair of crossbars slidably mounted in tracks in such opening for cyclical reciprocating movement towards and away from each other, fingers extending downwardly from each of the crossbars, resilient pads on the outer, free ends of the fingers, a pair of meshing gears above the crossbars between the tracks, arms eccentrically connected to the gears and connected to the crossbars for effecting reciprocating movement of the crossbars in the tracks and of the fingers and pads with the crossbars, an electric motor, and speed reducing transmission means connected to the motor and to the gears for rotating the latter at a slow speed.

3 Claims, 3 Drawing Sheets

SCALP KNEADER

BACKGROUND OF THE INVENTION

This invention relates to a massaging device, and in particular to a scalp kneader.

While the device is primarily intended for massaging the scalp, it will be appreciated that the device can be used for massaging other portions of the human body.

Manually or motor operated massaging devices are by no means new. Examples of such devices are described in U.S. Pat. Nos. 718,766, issued to P. D. Ingram on Jan. 20, 1903; 1,377,140, issued to F. K. North on May 3, 1921; 1,391,919, issued to L. A. Thompson on Sept. 27, 1921; 2,038,846, issued to C. A. Matson on Apr. 28, 1936; 2,232,493, issued to A. M. Stuckey et al on Feb. 18, 1941; 2,690,746, issued to E. E. Echberger on Oct. 5, 1954 and 2,706,980, issued to R. Kahn on April 26, 1955 and U.K. Pat. No. 385,711 issued to W. S. P. Alexander on Jan. 5, 1933.

The patented devices suffer from a variety of disadvantages, including unnecessary complexity, solely manual operation, and, perhaps more importantly, a rotary massaging action. In this connection, it has been found that gentle kneading of the scalp is more pleasant than simple massaging. By kneading of the scalp is meant the repeated bunching up and releasing of scalp tissue, which is effected by reciprocation of the massaging or kneading heads. Most prior art massage devices rely on rotary motion of the heads for massaging the skin or tissue of the body.

The object of the present invention is to eliminate the drawbacks of existing machines or apparatuses by providing a relatively simple motor operated massage device, which can be used to knead the scalp efficiently.

BRIEF SUMMARY OF THE INVENTION

Accordingly, the present invention relates to a massage device comprising casing means; parallel track means in an open end of said casing means; a pair of crossbar means slidably mounted in said track means for reciprocating movement towards and away from each other; finger means extending outwardly from said crossbar means; resilient pad means carried by said finger means for massaging the skin of a user; a first pair of meshing gear means between said track means; arm means eccentrically connected to said first gear means for effecting rotation of one end of said arm means, and consequently reciprocating movement of said crossbar means in said track means and of said finger means and said pad means with said arm means; motor means; and transmission means connecting said motor means to said first gear means for rotating the latter at a slow speed.

BRIEF DESCRIPTION OF THE DRAWINGS

The invention will now be described in greater detail with reference to the accompanying drawing, which illustrates a preferred embodiment of the invention, and wherein.

DESCRIPTION OF THE PREFERRED EMBODIMENT

Figure 2:
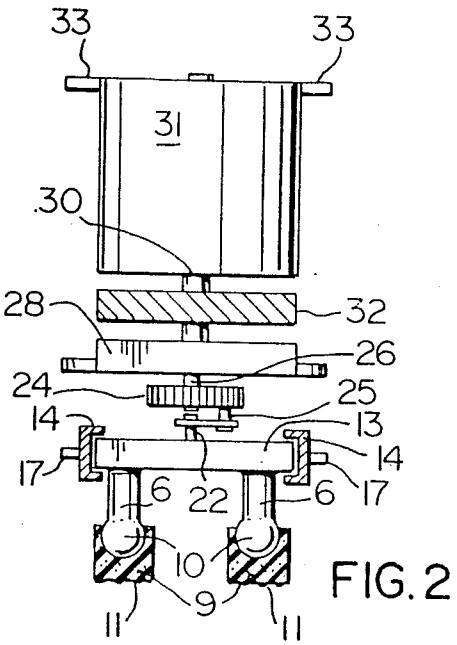
FIG. 2 is a schematic, partly sectioned end view of the interior of the device of FIG. 1.
Figure 1:
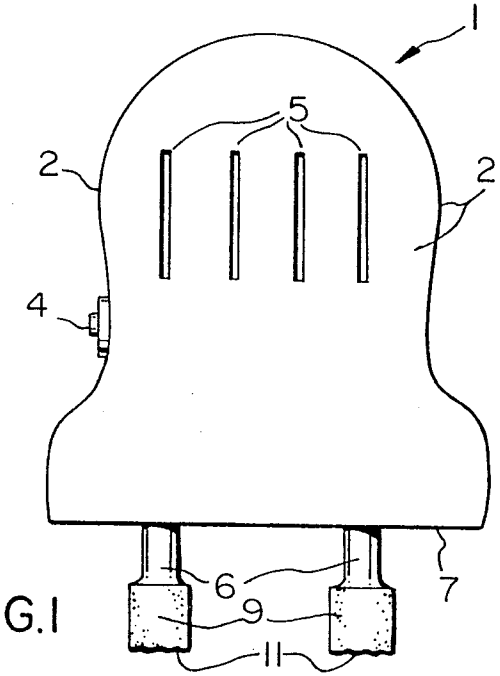
FIG. 1 is a schematic end view of a massage device in accordance with the present invention.

With reference to the drawing, a massage device in accordance with the present invention includes a casing generally indicated at 1, with contoured sides 2 and a planar end 3 intended to facilitate manual handling of the device. A button 4 for starting and stopping the device is provided in one side 2 of the casing 1, and ventilation slots 5 are provided in the casing 1.

Four rod-shaped fingers 6 extend downwardly from the open bottom 7 of the casing. Resilient, rectangular pads 9 are mounted on the spherical bottom ends 10 of the fingers 6. Thus, the pads 9, which are formed of soft rubber can rotate on the ends 10 of the fingers 6. The bottom surfaces 11 of the pads 9 are roughened to facilitate gripping of the skin.

Figure 4:
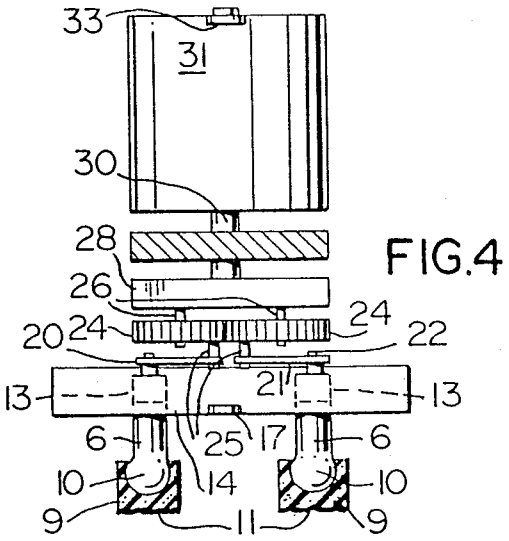
FIGS. 3 and 4 are schematic side elevation views of the elements of FIG. 2 in two positions.
Figure 3:
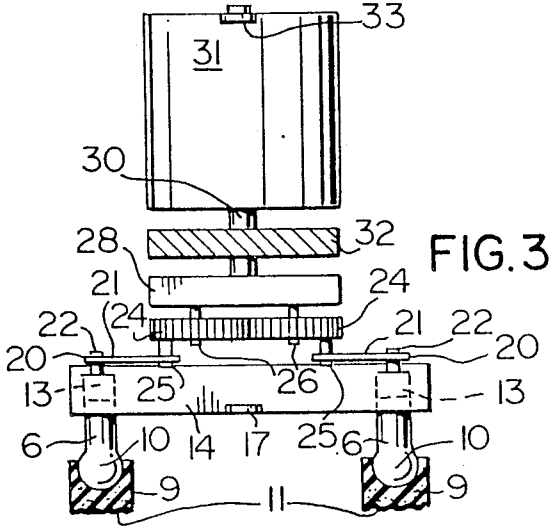
Figure 5:
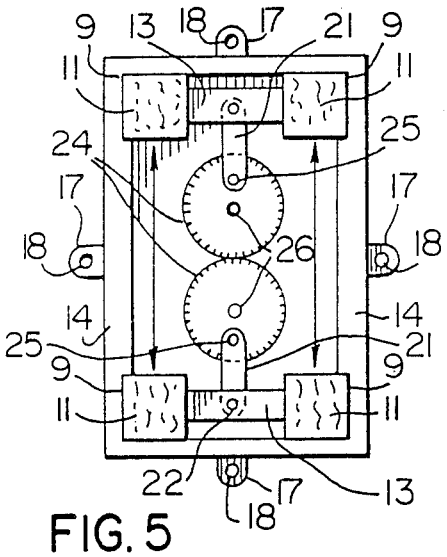
FIGS. 5 and 6 are schematic, bottom views of the elements of FIGS. 2 to 4 in two positions.
Figure 6:
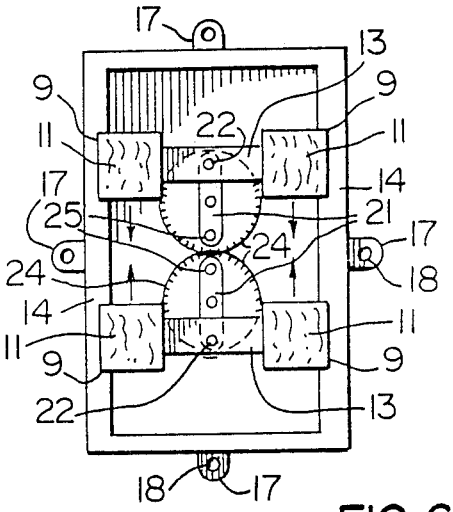

The rectangular pads 9 and the pair of fingers 6 at each end of the casing 1 can be reciprocated towards and away from each other. For such purpose, the top ends of each pair of fingers at each end of the casing 1 are attached to a crossbar 13. The two crossbars 13 are slidably mounted in tracks 14. The tracks 14, which are generally C-shaped define the sides of a rectangular border mounted in the open bottom end 7 of the casing 1 by means of lugs 17. Holes 18 are provided in the lugs 17 for receiving screws (not shown). One end 20 (FIGS. 3 and 4) of a link arm 21 is pivotally connected to the center of the crossbar 13 by a pin 22. The other end of the link arm 21 is pivotally connected to one side of a gear 24 by a pin 25. Thus, the arms 21 and the gears 24 define eccentrics which cause movement of the pads 9 towards and away from each other during rotation of the gears 24. The gears 24 are permanently meshed with each other to ensure synchronous movement of the pairs of pads 9 at each end of the casing 1 towards and away from each other.

The gears 24 are mounted on the bottom ends of shafts 26, which extend upwardly into the- -.reduction unit indicated schematically by block 28. The reduction unit 28 is intended to reduce the rotation of the gears 24, and consequently of the pads 11 to approximately one cycle per second. Typically, the reduction unit includes a small gear (not shown) connected to larger gears (not shown), which support the shafts 26. The smallest gear of the reduction unit 28 is mounted on the end of a drive shaft 30. The drive shaft 30 is driven by an electric motor 31. A fan 32 is also mounted on the drive shaft 30 for drawing ambient air into slots 5 to cool the motor 31. Lugs 33 extend outwardly from the motor housing for mounting the motor in the casing 1.

Figure 7:
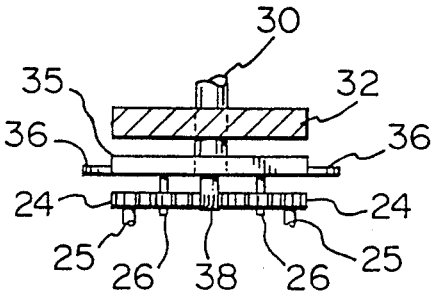
FIG. 7 is a schematic, side elevation view of a position of a second embodiment of 16 invention.
Figure 8:
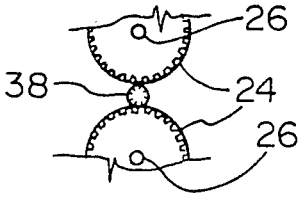
FIG. 8 is a bottom view of the central position of the 16 device of FIG. 17.

In a second embodiment of the invention (FIGS. 7 and 8), the reduction unit 28 is replaced by a plate 35, which is provided with lugs 36 for mounting the plate in the casing 1. Teeth are provided on the reduced diameter bottom end 38 of the shaft 30, which extends through an opening in the Plate 35 to a location between the gears 24. Thus, the shaft 30 can drive the gears 24 directly, the diameter of the reduced bottom end 38 of the shaft 30 and of the gears 24, and the number of teeth on each dictating the speed of rotation of the gears 24. The gears 24 are mounted on the bottom ends of shafts 26, which extend upwardly into the plate 35. The drive system can include a variable speed electric motor, or a cordless, rechargeable battery powered motor.

In operation, the button 4 is depressed to start the motor 31. Rotation of shaft 30 causes rotation of the shafts 26 and of the gears 24 which results in reciprocating movement of the crossbars 13, the fingers 6 and the resilient pads 9. When the device is placed against the scalp of a user, the irregular surfaces 11 of the pads 9 tend to draw the scalp tissue together and to push such tissue apart in a cyclical reciprocating movement, i.e. to effect a kneading action on the scalp. By using a transmission (the reduction unit 28 or the arrangement of FIGS. 7 and 8) with the proper step down, the pads 9 can be caused to reciprocate at one cycle per second. Cooling air drawn into the slots 5 is expelled through the open bottom end of the casing 1. Downward movement of air tends to keep the hair of the user away from the drive mechanism. Of course, a cover plate (not shown) can be mounted in the open bottom end between the crossbar 13 and the arms 21, with longitudinally extending guide slots for the pins 22. With such a structure, the dimensions of the pins 22 would require changing to provide space for the plate.

What is claimed is:

1. A massage device comprising:

(a) casing means having a top and a bottom, an inner chamber and an opening in the bottom to said inner chamber, (b) said chamber including inner walls, (c) motor means positioned in said chamber, (d) said chamber including track means extending at least along one of said inner walls of said casing means, (e) at least one pair of massaging means mounted on said track means and extending outwardly from said opening, (f) means for mounting each of said massaging means for reciprocal movement with respect to each other and said track means, (g) drive means associated with said motor means and connected to said pair of massaging means for reciprocally driving each of said massaging means relative to said track means, and to each other, (h) said drive means associated with said motor means and driven by said motor means for reciprocally driving said massaging means includes a gear means, a transmission means and an eccentrically mounted linking means, (i) said transmission means is portable by said motor means to transmit rotation to said gear means, (j) said gear means is eccentrically connected to said linking means to impart a reciprocating motion to said linking means, and (k) said linking means comprising a cross arm connected to each one of each pair of massaging means and a link arm connecting said cross arm and said driving means for transmitting the reciprocating motion to said massaging means, said track means includes a pair of spaced parallel tracks.

2. The massage device of claim 1, wherein:

(a) each of said massaging means of said pair is mounted for reciprocal movement towards and away from each other.

3. The massage device of claim 2, further comprising:

(a) pad means mounted on said massaging means for contacting a user'skin.

* * * * *